US006036547A

United States Patent [19]

Belopolsky et al.

[11] Patent Number: 6,036,547

[45] Date of Patent: Mar. 14, 2000

[54] DOUBLE DECK GANG JACK EXHIBITING SUPPRESSED MUTUAL CROSSTALK

[75] Inventors: Yakov Belopolsky, Harrisburg; Lee W. Potteiger, Lewisberry, both of Pa.

[73] Assignee: Berg Technology, Inc., Reno, Nev.

[21] Appl. No.: 09/143,810

[22] Filed: Aug. 31, 1998

Related U.S. Application Data

[60] Provisional application No. 60/076,844, Mar. 5, 1998, and provisional application No. 60/076,894, Mar. 5, 1998.

[51] Int. Cl.[7] ..... H01R 23/02

[52] U.S. Cl. ..... 439/626; 439/676

[58] Field of Search ..... 439/676

[56] References Cited

U.S. PATENT DOCUMENTS

| | | | |
|---|---|---|---|
| 5,449,299 | 9/1995 | Shimirak et al. | 439/417 |
| 5,496,195 | 3/1996 | Reed | 439/607 |
| 5,531,612 | 7/1996 | Goodall et al. | 439/541.5 |
| 5,562,507 | 10/1996 | Kan | 439/676 |
| 5,586,914 | 12/1996 | Foster, Jr. et al. | 439/676 |
| 5,599,209 | 2/1997 | Belopolsky | 439/676 |
| 5,639,267 | 6/1997 | Loudermilk | 439/701 |
| 5,700,167 | 12/1997 | Pharney et al. | 439/676 |
| 5,879,199 | 3/1999 | Belopolsky | 439/701 |

*Primary Examiner*—Paula Bradley
*Assistant Examiner*—Truc Nguyen
*Attorney, Agent, or Firm*—Daniel J. Long; Brian J. Hamilla; M. Richard Page

[57] ABSTRACT

A modular jack assembly which includes an insulative housing with a first longitudinal wall, a second longitudinal wall superimposed over the first longitudinal wall in spaced parallel relation. A third longitudinal wall is superimposed over the second longitudinal wall in spaced parallel relation. There is a first pair of spaced transverse walls interposed between the first and second longitudinal wall to form a first plug receiving port. There is also a second pair of spaced transverse walls interposed between the second and third longitudinal wall to form a second plug receiving port. The first plug receiving port is longitudinally displaced from said second plug receiving port. A first insulative insert having base and upper sides and rear end terminal ends is positioned so that its terminal end extends into the first plug receiving port. A second insulative insert having base and upper sides and rear and terminal ends is positioned so that its terminal end extends into the second plug receiving port.

16 Claims, 6 Drawing Sheets

DOUBLE DECK GANG JACK EXHIBITING SUPPRESSED MUTUAL CROSSTALK

CROSS REFERENCE TO RELATED APPLICATION

This application claims rights under U.S. application Ser. No. 60/076,844 (CR-4521P) entitled "Double Deck Gang Jack Exhibiting Suppressed Mutual Crosstalk", filed Mar. 5, 1998.

This is related to application Ser. No. 60/076,894 (EL-8057 P) entitled "Stacked Double Deck Modular Gang Jack Connector", filed Mar. 5, 1998.

BACKGROUND OF THE INVENTION

1. Field of the Invention

The present invention relates to electrical connectors and more particularly to modular gang jacks.

2. Brief Description of Prior Developments

In order to increase density of electronic assemblies and reduce costs, the equipment manufacturers want to incorporate as many channel lines into the network or telecommunications equipment as possible. These channels are supported by common electronics (power supplies, logic, control and supervision circuitry). Cost benefits arise with a reduction of a ratio between common electronics and a number of channels. At the same time, to increase the information transmission rates, the frequency of the transmitted signals needs to be higher, typically over 100 MHz. Each channel is connected to the physical network by a modular jack. Modular jack signal contacts are divided into differential pairs according to TIA/EIA 568. When the density and signal frequency increases the issues related to the electromagnetic interference become more important.

In view of the above, advanced applications require modular jacks of a smaller size or in an arrangement that supports the high density equipment configuration as well as of improved electromagnetic compatibility.

SUMMARY OF THE INVENTION

The present invention is a modular jack assembly which includes an insulative housing with a first longitudinal wall, a second longitudinal wall superimposed over the first longitudinal wall in spaced parallel relation. A third longitudinal wall is superimposed over the second longitudinal wall in spaced parallel relation. There is a first pair of spaced transverse walls interposed between the first and second longitudinal wall to form a first plug receiving port. There is also a second pair of spaced transverse walls interposed between the second and third longitudinal wall to form a second plug receiving port. The first plug receiving port is longitudinally displaced from said second plug receiving port. A first insulative insert having base and upper sides and rear end terminal ends is positioned so that its terminal end extends into the first plug receiving port. A second insulative insert having base and upper sides and rear and terminal ends is positioned so that its terminal end extends into the second plug receiving port.

BRIEF DESCRIPTION OF THE DRAWINGS

The invention is further described with reference to the accompanying drawings in which.

DETAILED DESCRIPTION OF THE PREFERRED EMBODIMENTS

In one possible configuration, mod jacks are arranged in two or more rows. It is desirable that overall height is as low as allowed by governing standards, in particular the FCC rules part 68 subpart F.

The high speed performance is characterized by two major parameters: low crosstalk and low attenuation. Attenuation is a function of signal line impedance to a time varying signal. At higher frequencies, above 10 MHz, impedance becomes mostly inductive and directly proportional to the terminal length. The reduction in the impedance results in the lower signal attenuation. To reduce electrical crosstalk between pairs in each modular jack the electrical contacts are arranged in such fashion that causes minimal transfer of energy from one pair to another. Furthermore, by arranging contacts in the illustrated fashion the crosstalk generated in one portion of a pair is reduced by a crosstalk generated in another part of the same pair. In all cases it is assumed that the crosstalk current flows in the same direction as a current which causes it. In the proposed invention the modular jacks are arranged in two rows. The top row is inverted in regard to the bottom row, so that the overall length of a top row signal contact is reduced.

The crosstalk between adjacent jacks (ports) has to be suppressed. The adjacent ports in this design are located in vertical and horizontal directions. Since the crosstalk will be minimized with increase of the distance between differential pairs, the pairs shall be arranged at the greatest possible distance. If the distance between rows is increased, that would increase signal length and attenuation.

On the other hand, the top and bottom rows can be off-set. If such an offset is great (typically exceeds 0.120") it results in the increase of overall length of assemblies or asymmetrical design, i.e. top and bottom row may have different number of ports.

To address both issues simultaneously, one of the features of the proposed invention is to off-set top and bottom ports in such fashion that top contacts are located between bottom port contacts. Such configuration can be achieved by shifting the top row by 0.020" or 0.040" or 0.060" in regard to the bottom row.

By such an arrangement the distance between closest top and bottom contacts is increased by a minimum factor of 1.41. In addition to this, respective differential pairs are positioned in a fashion that common planes intersect at an angle close to 90°. It is believed that such configuration can further reduce the crosstalk.

The crosstalk suppression between adjacent ports is achieved by using pairs 1–2 and 7–8 in each port with significant ability to suppress mutual crosstalk.

Figure 1:
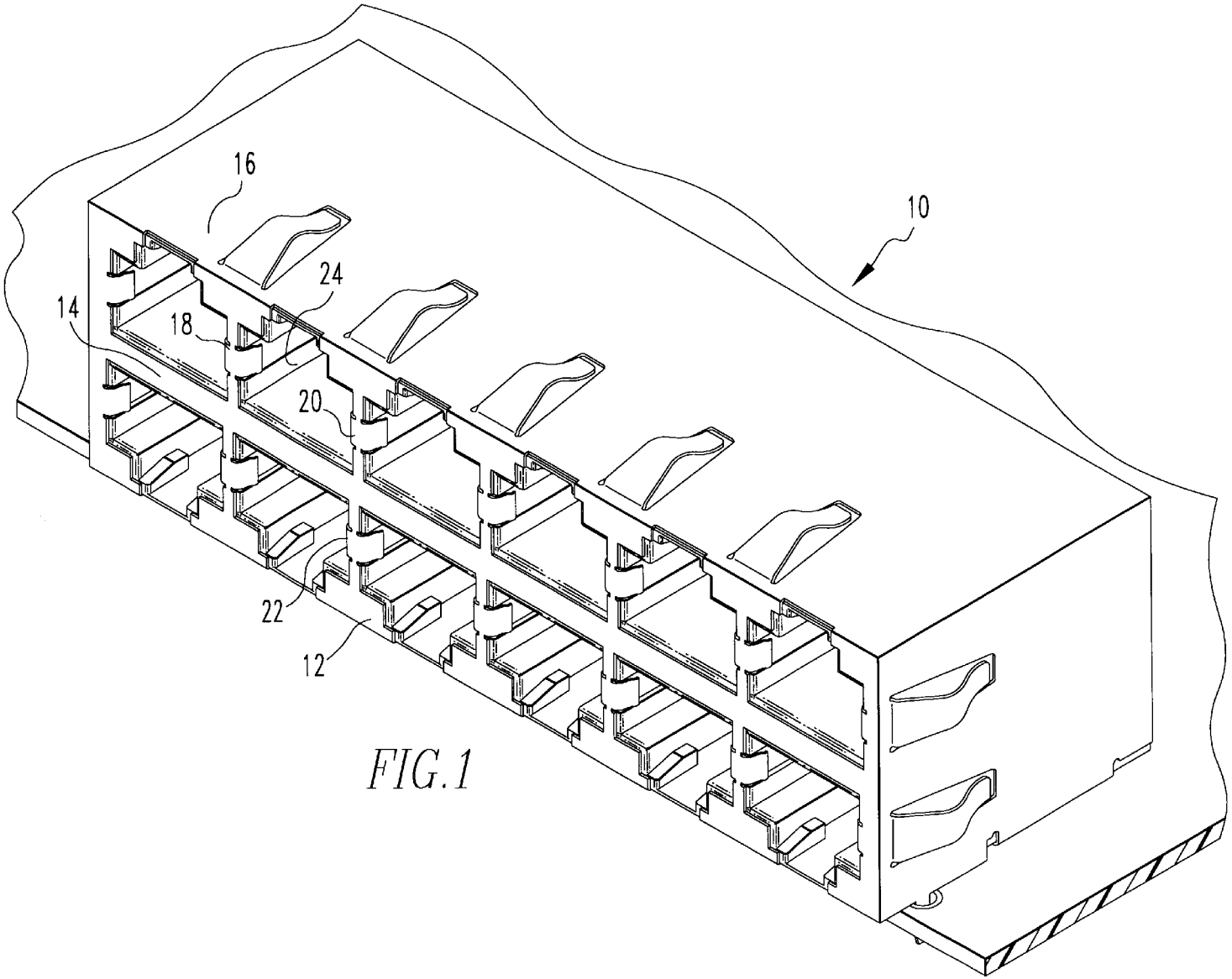
FIG. 1 is a front top perspective view of a modular gang jack representing a preferred embodiment of the present invention.
Figure 2:
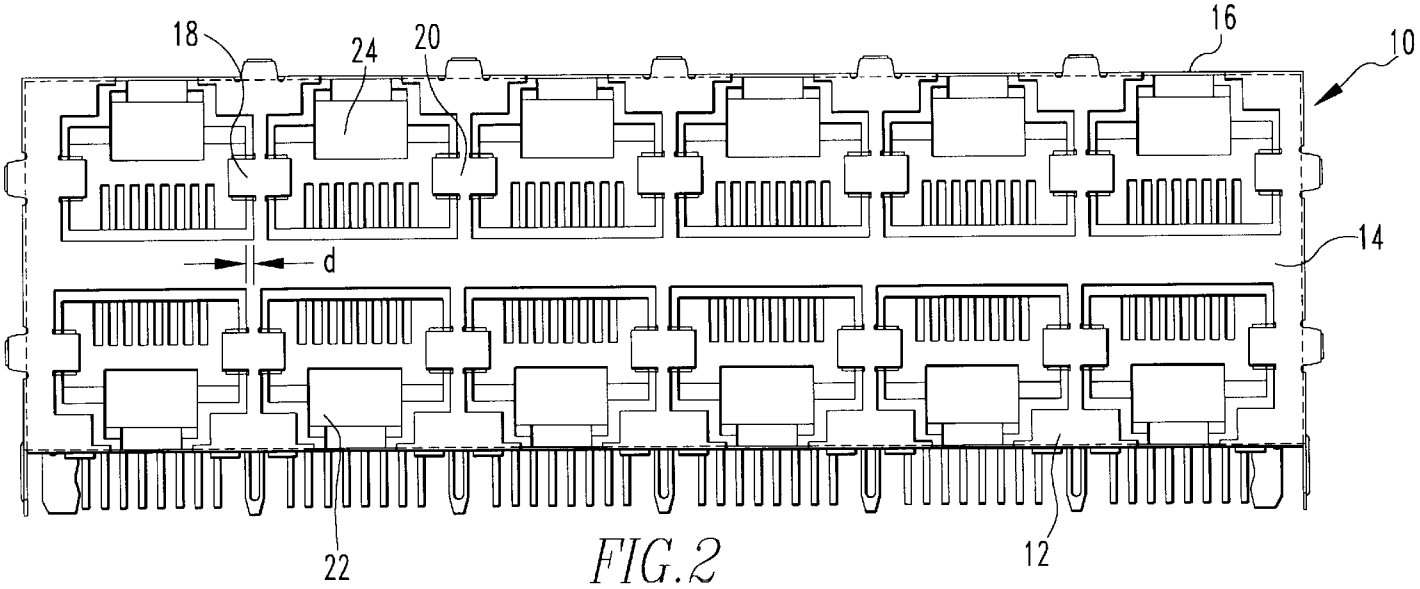
FIG. 2 is a front elevational view of the modular gang jack shown in FIG. 1.
Figure 4:
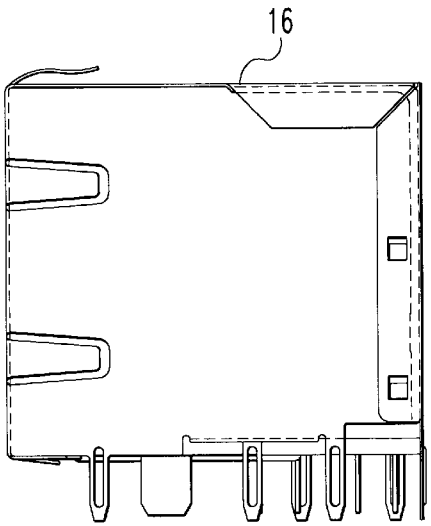
FIG. 4 is an end view of the modular gang jack shown in FIG. 2.
Figure 3:
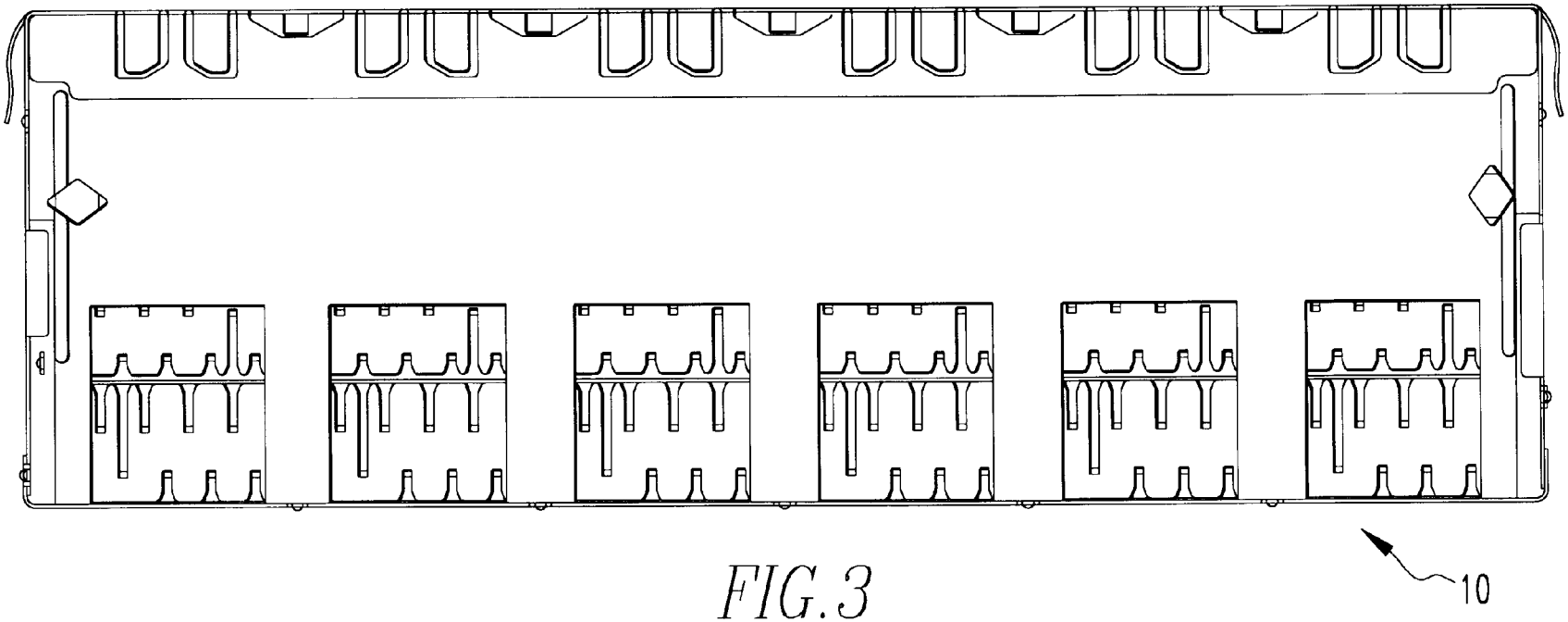
FIG. 3 is a bottom plan view of the modular gang jack shown in FIG. 2.
Figure 8:
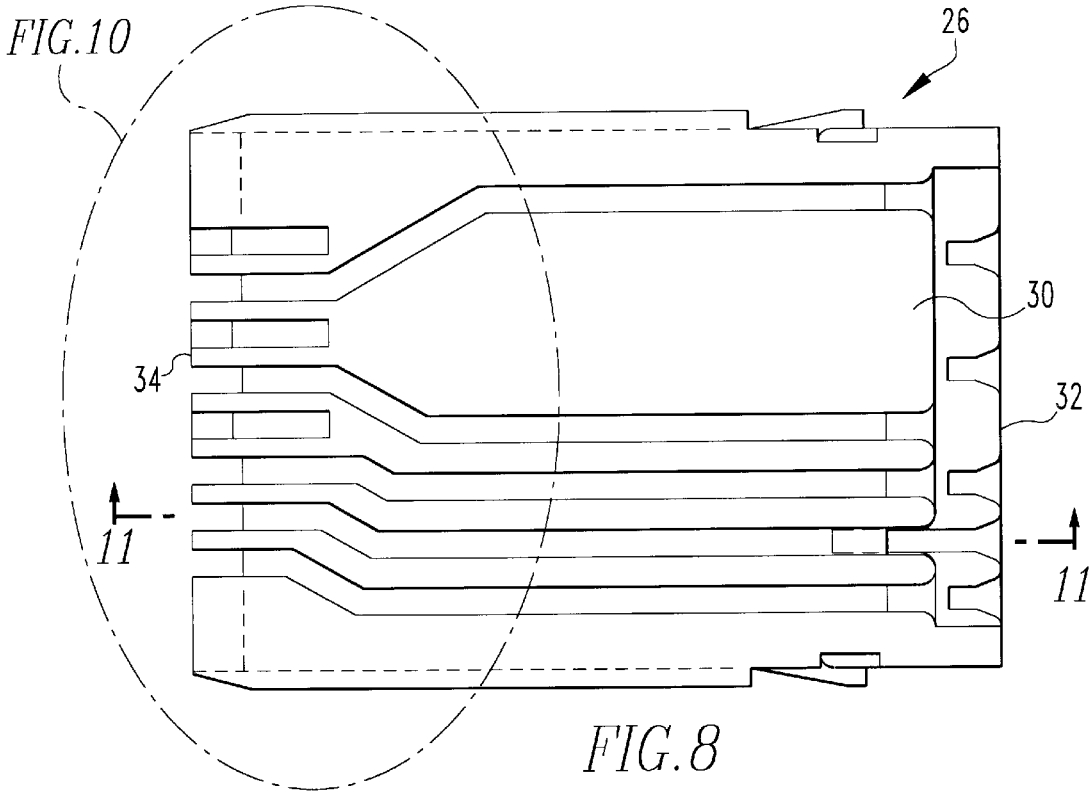
FIG. 8 is a top plan view of the insert shown in FIG. 5.
Figure 5:
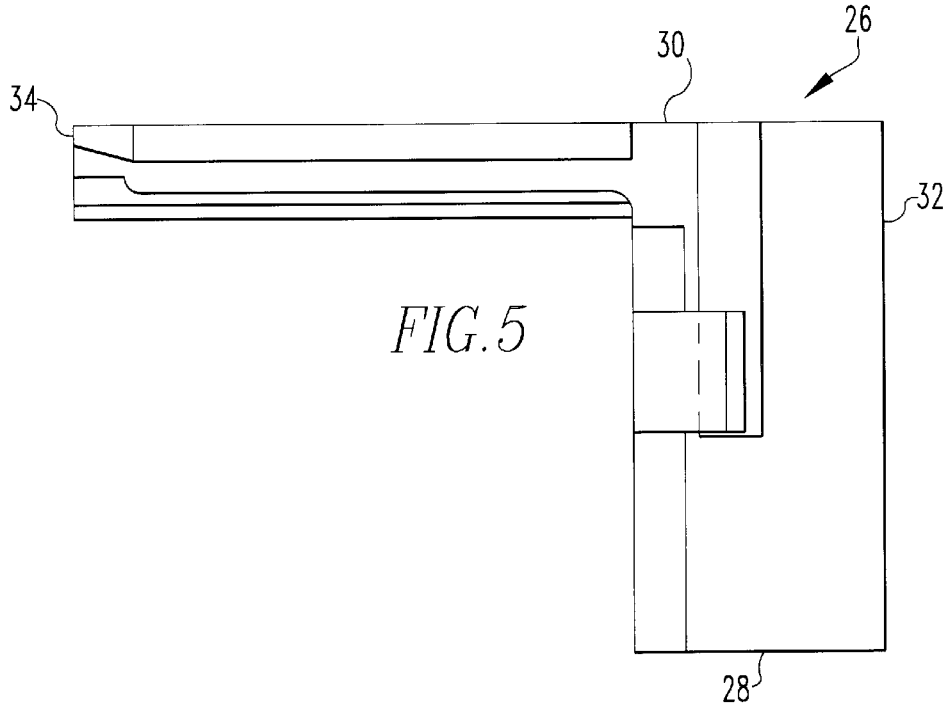
FIG. 5 is a side elevational view of an insert used in the modular gang jack shown in FIG. 1.
Figure 6:
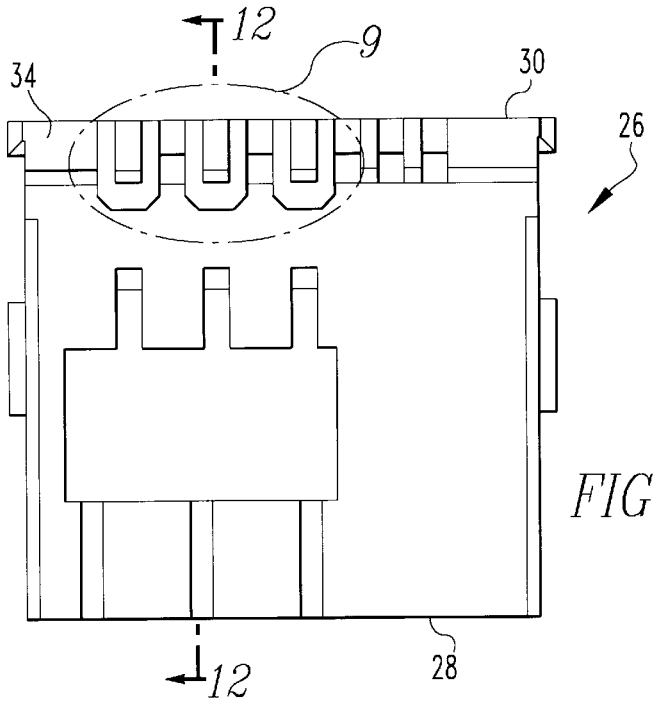
FIG. 6 is a front elevational view of the insert shown in FIG. 5.
Figure 9:
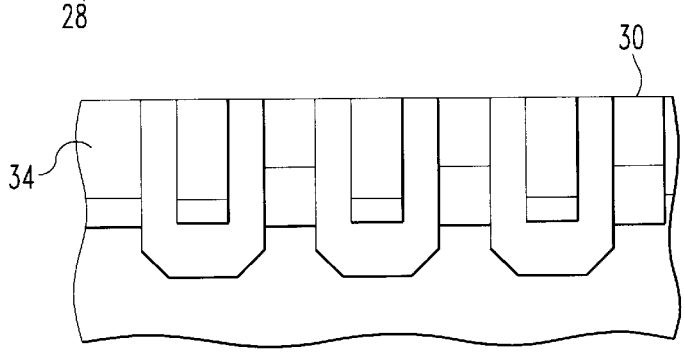
FIG. 9 is an enlarged view of the area within circle 9 in FIG. 6.
Figure 7:
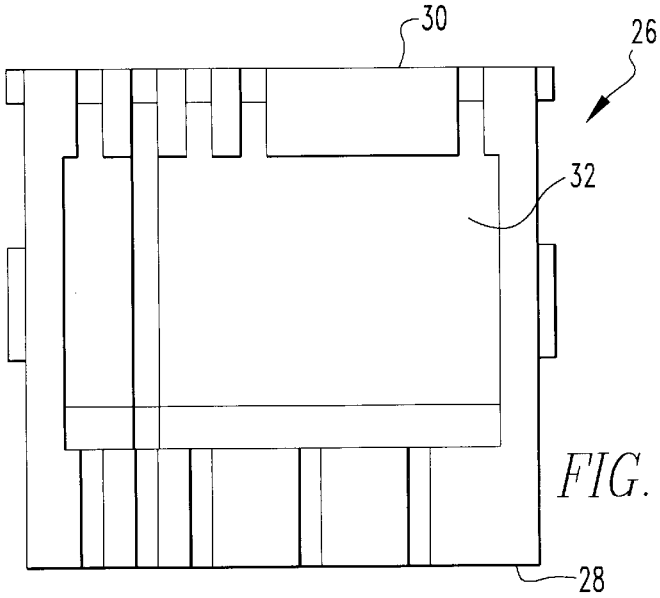
FIG. 7 is a rear elevational view of the insert shown in FIG. 5.
Figure 10:
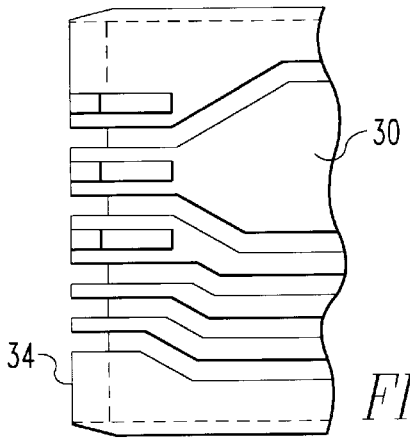
FIG. 10 is an enlarged view of the area within circle 10 in FIG. 8.
Figure 11:
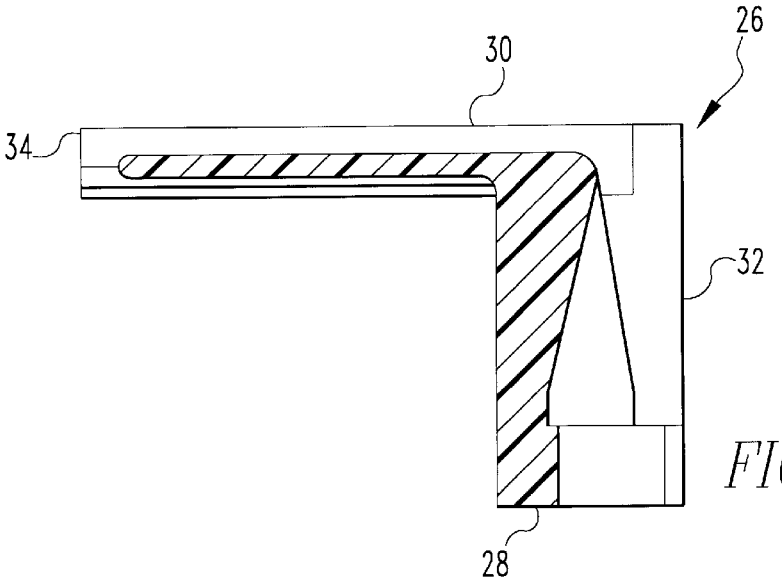
FIG. 11 is a cross sectional view through 11—11 in FIG. 8.
Figure 12:
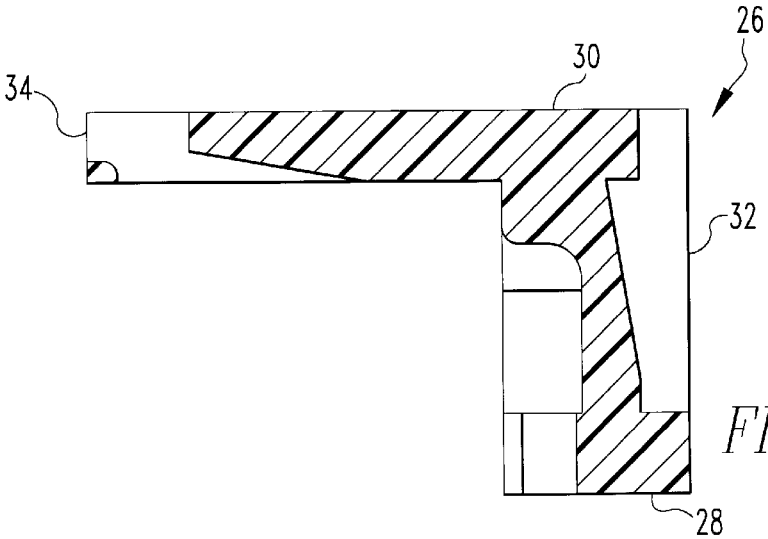
FIG. 12 is a cross sectional view through 12—12 in FIG. 6.

Referring to FIGS. 1–4, the modular gang jack of the present invention includes a shielded insulative housing shown generally at numeral 10. This housing has a lower longitudinal wall 12, a medial longitudinal wall 14 and an upper longitudinal wall 16. Interposed between these longitudinal walls there are transverse walls as at wall 18 and wall 20. These transverse walls form with the longitudinal walls plug receiving ports as at port 22 and 24. It will be seen that adjacent between the lower and medial longitudinal wall and between the medial and upper longitudinal wall are longitudinally displaced by a distance d (FIG. 2).

Referring to FIGS. 5–12, the insulative insert inserted in the ports from the rear side of the housing is shown generally at numeral 26. This insert has a base side 28, an upper side 30, a rear end 32 and a forward end 34. As is conventional the forward end is inserted into the ports, and wires extend upwardly from the base side to the upper side and then to the forward end from where they extend obliquely toward the base side.

It is found that the double deck gang jack described above exhibits surprisingly and unexpectantly suppressed mutual cross talk.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack assembly comprising:

(a) an insulative housing comprising a first longitudinal wall, a second longitudinal wall superimposed over said first longitudinal wall in spaced parallel relation and a third longitudinal wall superimposed over the second longitudinal wall in spaced parallel relation and wherein there is a first pair of spaced transverse walls interposed between the first and second longitudinal wall to form a first plug receiving port and there is a second pair of spaced transverse walls interposed between the second and third longitudinal wall to form a second plug receiving port and said first plug receiving port is positioned generally beneath the second plug receiving port and is longitudinally displaced from said second plug receiving port by from about 0.020" to about 0.060";

(b) a first insulative insert having base and upper sides and rear end terminal ends and being positioned so that its terminal end extends into the first plug receiving port; and said first insulative insert has a plurality of contacts; and (c) a second insulative insert having base and upper sides and rear and terminal ends and being positioned so that its terminal end extends into the second plug receiving port and said second insulative insert has a plurality of contacts, and at least one of said contacts on said second insulative insert is longitudinally positioned between contacts on said first insulative insert.

2. The modular jack assembly of claim 1 wherein the first plug receiving port is longitudinally displaced from the second plug receiving port by about 0.020".

3. The modular jack assembly of claim 1 wherein the first plug receiving port is longitudinally displaced from the second plug receiving port by about 0.040".

4. The modular jack assembly of claim 1 wherein the first plug receiving port is longitudinally displaced from the second plug receiving port by about 0.060".

5. The modular jack assembly of claim 1 wherein there are a plurality of pairs of spaced transverse walls interposed between the first and second longitudinal walls to form a plurality of first plug receiving ports and there are a plurality of spaced transverse walls interposed between the second and third longitudinal walls to form a plurality of second plug receiving ports.

6. The modular jack assembly of claim 5 wherein there are a plurality of first insulative inserts and each of said inserts has a base and an upper side and a rear end terminal end and each of said first insulative inserts is positioned in one of said first plurality of plug receiving ports such that its terminal end extends into one of the first plug receiving parts.

7. The modular jack assembly of claim 6 wherein there are a plurality of second insulative inserts and each of said first insulative inserts has a base and an upper side and a rear end terminal end and each of said second insulative inserts is positioned in one of said first plurality of plug receiving ports such that its terminal end extends into one of the first plug receiving ports.

8. The modular jack assembly of claim 7 wherein each of the first plug receiving ports is longitudinally displaced from one of the second plug receiving ports by about 0.020" or more.

9. The modular jack assembly of claim 8 wherein the first plug receiving port is longitudinally displaced from the second plug receiving port by from about 0.020" to about 0.060".

10. The modular jack assembly of claim 9 wherein the first plug receiving port is longitudinally displaced from the second plug receiving port by about 0.020".

11. The modular jack assembly of claim 9 wherein the first plug receiving port is longitudinally displaced from the second plug receiving port by about 0.040".

12. The modular jack assembly of claim 9 wherein the first plug receiving port is longitudinally displaced from the second plug receiving port by about 0.060".

13. A method of assembling a modular jack comprising the steps of:

(a) providing an insulative housing comprising: a first longitudinal wall, a second longitudinal wall superimposed over said first longitudinal wall in spaced parallel relation and a third longitudinal wall superimposed over the second longitudinal wall in spaced parallel relation and wherein there is a first pair of spaced transverse walls interposed between the first and second longitudinal wall to form a first plug receiving port and there is a second pair of spaced transverse walls interposed between the second and third longitudinal wall to form a second plug receiving port and said first plug receiving port is and positioned generally beneath the second plug receiving port and is longitudinally displaced from said second plug receiving port by from about 0.020" to about 0.060", (b) positioning a first insulative insert having base and upper sides and rear end terminal ends that its terminal end extends into the first plug receiving port; and said first insulative insert has a plurality of contacts; and (c) positioning a second insulative insert having base and upper sides and rear end terminal ends so that its terminal end extends into the second plug receiving port and said second insulative insert has a plurality of contacts, and at least one of said contacts on said second insulative insert is longitudinally positioned between contacts on said first insulative insert.

14. The method of claim 13 wherein the first plug receiving port is longitudinally displaced from the second plug receiving port by about 0.020".

15. The method of claim 13 wherein the first plug receiving port is longitudinally displaced from the second plug receiving port by about 0.040".

16. The method of claim 13 wherein the first plug receiving port is longitudinally displaced from the second plug receiving port by about 0.060".

* * * * *